US008956134B2

(12) United States Patent
McDaniel, Jr. et al.

(10) Patent No.: US 8,956,134 B2
(45) Date of Patent: Feb. 17, 2015

(54) FIXED-VANE POSITIVE DISPLACEMENT ROTARY DEVICES

(75) Inventors: David Alton McDaniel, Jr., Charlottesville, VA (US); Thomas Towles Lawson, Jr., Charlottesville, VA (US); James W. Newman, Jr., Charlottesville, VA (US)

(73) Assignee: Mallen Research Limited, Charlottesville, VA (US)

( * ) Notice: Subject to any disclaimer, the term of this patent is extended or adjusted under 35 U.S.C. 154(b) by 238 days.

(21) Appl. No.: 13/593,279

(22) Filed: Aug. 23, 2012

(65) Prior Publication Data

US 2014/0056745 A1 Feb. 27, 2014

(51) Int. Cl.

| | |
|---|---|
| ***F03C 2/00*** | (2006.01) |
| ***F03C 4/00*** | (2006.01) |
| ***F04C 2/00*** | (2006.01) |

(52) U.S. Cl.

USPC ..... 418/196; 418/112; 418/191

(58) Field of Classification Search

CPC ..... F01C 1/20; F01C 1/28; F01C 1/123; F01C 19/02; F04C 2/18; F04C 27/001; F04C 27/004

USPC ..... 418/196, 191, 112–113, 123

See application file for complete search history.

(56) References Cited

U.S. PATENT DOCUMENTS

| | | | | |
|---|---|---|---|---|
| 562,405 | A | 6/1896 | Kryszat | |
| 597,793 | A | 1/1898 | Taylor | |
| 1,766,519 | A * | 6/1930 | Johnson | 418/196 |
| 2,152,564 | A * | 3/1939 | Perkins | 418/196 |
| 2,198,130 | A | 4/1940 | Schweiger | |
| 2,571,642 | A | 10/1951 | Yancy | |
| 2,690,164 | A | 9/1954 | Skok | |
| 2,863,425 | A | 12/1958 | Breelle | |
| 2,920,814 | A | 1/1960 | Breelle | |

(Continued)

FOREIGN PATENT DOCUMENTS

| | | |
|---|---|---|
| DE | 3318519 A1 | 11/1984 |
| EP | 0137421 A2 | 4/1985 |
| WO | 00/66886 A1 | 11/2000 |

OTHER PUBLICATIONS

International Searching Authoriy, International Search Report for International Application PCT/US2013/056083, dated Apr. 17, 2014.

(Continued)

*Primary Examiner* — Theresa Trieu

(74) *Attorney, Agent, or Firm* — Baker Botts L.L.P.

(57) ABSTRACT

A fixed vane positive displacement rotary device is disclosed that includes a primary rotor and one or more scavenging rotors rotatably disposed in a rotor encasement. The primary rotor includes a plurality of protrusions. And each of the scavenging rotors includes a first curved surface that is configured to move adjacent to the primary rotor between the protrusions as the primary rotor and scavenging rotors rotate, a protrusion-receiving groove extending that is configured to receive one of the plurality of protrusions therein so that at least a tip of that protrusion moves adjacent to the protrusion-receiving groove as the primary rotor and scavenging rotors rotate, and a second curved surface and a third curved surface extending away from a center of the protrusion-receiving groove on opposing sides of the protrusion-receiving groove that are configured to move adjacent to a leading side and a trailing side of the one protrusion, respectively.

16 Claims, 7 Drawing Sheets

(56) References Cited

U.S. PATENT DOCUMENTS

| | | | |
|---|---|---|---|
| 3,116,666 | A | 1/1964 | Scott |
| 3,123,012 | A | 3/1964 | Gilreath |
| 3,297,006 | A | 1/1967 | Marshall |
| 3,416,458 | A | 12/1968 | Kopfli |
| 3,621,820 | A | 11/1971 | Newsom |
| 3,846,055 | A | 11/1974 | Brundage |
| 3,941,527 | A | 3/1976 | Allington |
| 4,002,033 | A | 1/1977 | Welch |
| 4,057,035 | A | 11/1977 | Su |
| 4,086,880 | A | 5/1978 | Bates |
| 4,512,302 | A | 4/1985 | Bunce |
| 4,915,600 | A | 4/1990 | Hutchinson |
| 4,971,002 | A | 11/1990 | Le |
| 5,357,923 | A | 10/1994 | Osterburg et al. |
| 5,947,713 | A | 9/1999 | Ohman et al. |
| 6,132,197 | A | 10/2000 | Adamovski et al. |
| 6,244,240 | B1 | 6/2001 | Mallen |
| 6,543,406 | B1 | 4/2003 | Pohjola |
| 6,550,443 | B1 * | 4/2003 | Vanmoor ..... 418/196 |
| 7,201,134 | B2 | 4/2007 | Guest et al. |
| 7,621,116 | B2 | 11/2009 | Rom et al. |
| 7,841,082 | B2 | 11/2010 | Lurtz |
| 2007/0051087 | A1 | 3/2007 | Rom et al. |
| 2008/0087004 | A1 | 4/2008 | Van Blaricom |
| 2011/0296843 | A1 | 12/2011 | Lawson, Jr. |

OTHER PUBLICATIONS

International Searching Authority, Written Opinion of the International Searching Authority for International Application No. PCT/US2013/056083, dated Apr. 17, 2014.

* cited by examiner

FIXED-VANE POSITIVE DISPLACEMENT ROTARY DEVICES

BACKGROUND OF THE INVENTION

A. Field of the Invention

The present disclosure generally relates to fixed vane positive displacement rotary devices. The disclosed embodiments relate more specifically to fixed vane positive displacement rotary devices for generating power at an output shaft and methods for making same.

B. Related Technology

In general, conventional gas turbines have three basic stages 1) compression, 2) combustion, and 3) a power extraction. Energy extracted from a turbine is used to drive a compressor, which compresses air so that it may be mixed with fuel and burned in the combustor. The burnt fuel then exits the combustor through the turbine, which causes the turbine to rotate. The rotation of the turbine drives both the compressor and an output shaft.

Different types of gas turbines are defined by how much energy is extracted from the output shaft. For example, turbojets extract as little energy as possible from the output shaft to drive one or more compressor stages, such that much of the energy may be extracted as jet thrust from the compressed gases exiting the turbine. By contrast, turboshafts extract as much energy as possible from the output shaft to not only drive one or more compressor stages, but also to drive other machinery.

Gas turbines are dynamic devices, rather than positive displacement devices. In other words, the output shaft of a gas turbine moves in reaction to the pressure generated when fluid moving at a high speed is diffused, or slowed down, with the blades of the compressor and the turbine, rather than in reaction to pressure differences created on opposing sides of those blades in a constant volume of fluid. And while positive displacement devices move a nearly fixed volume of fluid per revolution of the output shaft at all speeds, the volume of air that a gas turbine moves must increase with the square of the revolutions of the output shaft. Accordingly, gas turbines are efficient at operating speeds that are well below their design speeds. Paradoxically, those operating speeds also are often above a speed that is practical to directly drive other machinery with the output shaft, such that more complicated machinery (e.g., a reduction gear) must be implemented to interface the output shaft of a gas turbine with other machinery.

In operation, gas turbines may be started by driving them with a starter motor. For example, the gas turbine may be driven to a speed where the compressor provides enough air pressure for fuel to be ignited in a combustor. If that speed is to great, however, the turbine may begin to act as a positive displacement fixed vane compressor, which would create a vacuum in the combustor. Combustion requires oxygen to react with fuel, and the greater the vacuum created in the combustor, the fewer oxygen molecules there are that may react with the fuel. Another problem with reduced pressure in the combustor is that compressed gas is hotter than ambient aid, while the decompressed air in a vacuum is cooler. Such cooled air provides a worse environment for combustion. The possibility of creating such conditions further limits the operating speed of gas turbines.

Positive displacement devices also have various limitations. For example, internal combustion engines configured as positive displacement devices (e.g. piston engines, Wankle engines, etc.) historically have not provided combustion in a constant volume. Instead, such reciprocating machines confine the charge gas, reduce its volume in a compression cycle, and then extract energy from an output shaft as the volume of the charge gas increases after being combusted in an expansion cycle. That process is highly inefficient due to losses not only from the compression cycle, but also from decreases in temperature during the expansion cycle.

In an effort to increase the power density of the reciprocating engine, hybrids of positive displacement devices and gas turbines have been developed, in a turbocharged reciprocating engine, for example, the reciprocating engine serves as the combustor for the turbine and the only work the turbine does is to drive the compressor that increases the air flow to the reciprocating engine so that it can burn more fuel. And in a supercharged reciprocating engine, the reciprocating engine drives a compressor with shaft power, rather than indirectly with combustion gases and a turbine. Nevertheless, many controls are required to effectively mate a dynamic compressor to a positive displacement device, such as the use of waste gates on turbochargers. Further, the limited operating speeds of dynamic compressors generally prevents their use when they are driven by the output shaft of the reciprocating engine, such as in supercharged reciprocating engines. Instead, less efficient positive displacement compressors generally are used in such applications.

BRIEF SUMMARY

To address the shortcomings of the prior art discussed above and to provide at least the advantages discussed below, the present disclosure is directed to fixed vane positive displacement rotary devices and methods for making same. The rotary device includes a rotor encasement with a central opening, a first rotor rotatably disposed within the central opening, and one or more second rotors rotatably disposed at an edge of the central opening so that at least a portion of each of the one or more second rotors extends radially into the central opening. The first rotor includes a main body and plurality of protrusions extending radially from the main body. And each of the one or more second rotors includes a first curved surface that is configured to move adjacent to the main body of the first rotor between the protrusions as the first rotor and one or more second rotors rotate relative to one another, a protrusion-receiving groove extending into the scavenging rotor that is configured to receive one of the plurality of protrusions therein so that at least a tip of the one protrusion moves adjacent to the protrusion-receiving groove as the first rotor and one or more second rotors rotate relative to one another, and a second curved surface and a third curved surface extending away from a center of the protrusion-receiving groove on opposing sides of the protrusion-receiving groove that are configured to move adjacent to a leading side and a trailing side of the one protrusion, respectively. Those and other objects of the present invention, as well as many of the intended advantages thereof, will become more readily apparent with reference to the following detailed description of the preferred embodiments, taken in conjunction with the accompanying drawings.

BRIEF DESCRIPTION OF THE DRAWINGS

Illustrative aspects of the present invention are described in detail with reference to the following figures, which form part of the disclosure, wherein.

In those figures, like reference numerals refer to like parts, components, structures, and/or processes.

DETAILED DESCRIPTION

Figure 1:
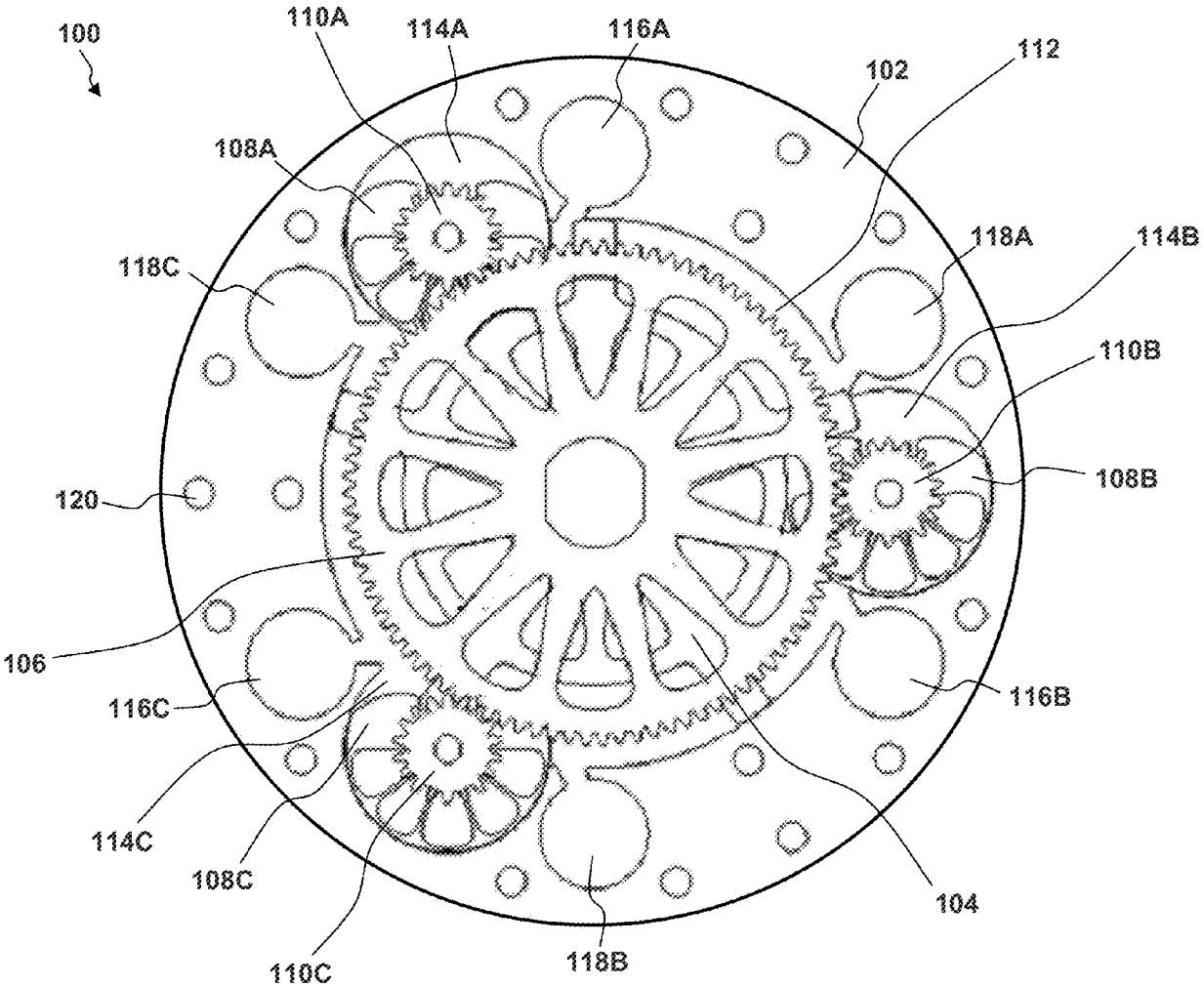
FIG. 1 is a sectional view illustrating a rotary device according to a non-limiting embodiment of the disclosure.

The embodiments of the present disclosure are directed to fixed vane positive displacement rotary devices for generating power at an output shaft and methods for making same. More particularly, the embodiments of the present disclosure are directed to fixed vane positive displacement rotary devices that achieve improved efficiency with non-contact seals that have tow levels of leakage. The need for lubrication within the rotary devices is eliminated through the use of those non-contact seals, and the need for additional structure to capture fluid leaking past the vanes is eliminated by scavenging rotors that are configured to maintain close tolerances with a primary rotor and its vanes as the primary rotor and scavenging rotors rotate relative to one another. Those close tolerances are maintained by the shape of scavenging rotors, which is defined by a plurality of intersecting curves that correspond to the multidirectional and intersecting movement of both the scavenging rotor and the vane as the primary rotor and scavenging rotor rotate relative to one another.

Several embodiments of the present invention are described below with respect to the drawings for illustrative purposes, it being understood that the invention may be embodied in other forms not specifically illustrated in the drawings. And in describing the embodiments illustrated in the drawings, specific terminology is resorted to for the sake of clarity. However, the present invention is not intended to be limited to the specific terms so selected, and it is to be understood that each specific term includes all technical equivalents that operate in similar manner to accomplish a similar purpose.

Turning to the drawings, FIG. 1 illustrates a fixed vane positive displacement rotary devices 100 according a non-limiting embodiment of the present disclosure. The rotary device 100 comprises a rotor encasement 102, a primary rotor 104, a primary gear 106, a plurality of scavenging rotors 108A-108C, and a plurality of secondary gears 110A-110C. The rotor encasement 102 comprises a circular central opening 112, a plurality of scavenging rotor openings 114A-114C, a plurality of circular intake openings 116A-116C, a plurality of circular exhaust openings 118A-118C, and a plurality of circular voids 120. The plurality of scavenging rotor openings 114A-114C, the plurality of circular intake openings 116A-116C, the plurality of circular exhaust openings 118A-118C, and the plurality of circular voids 120 each are equally spaced from each other around the central opening 112.

Figure 2:
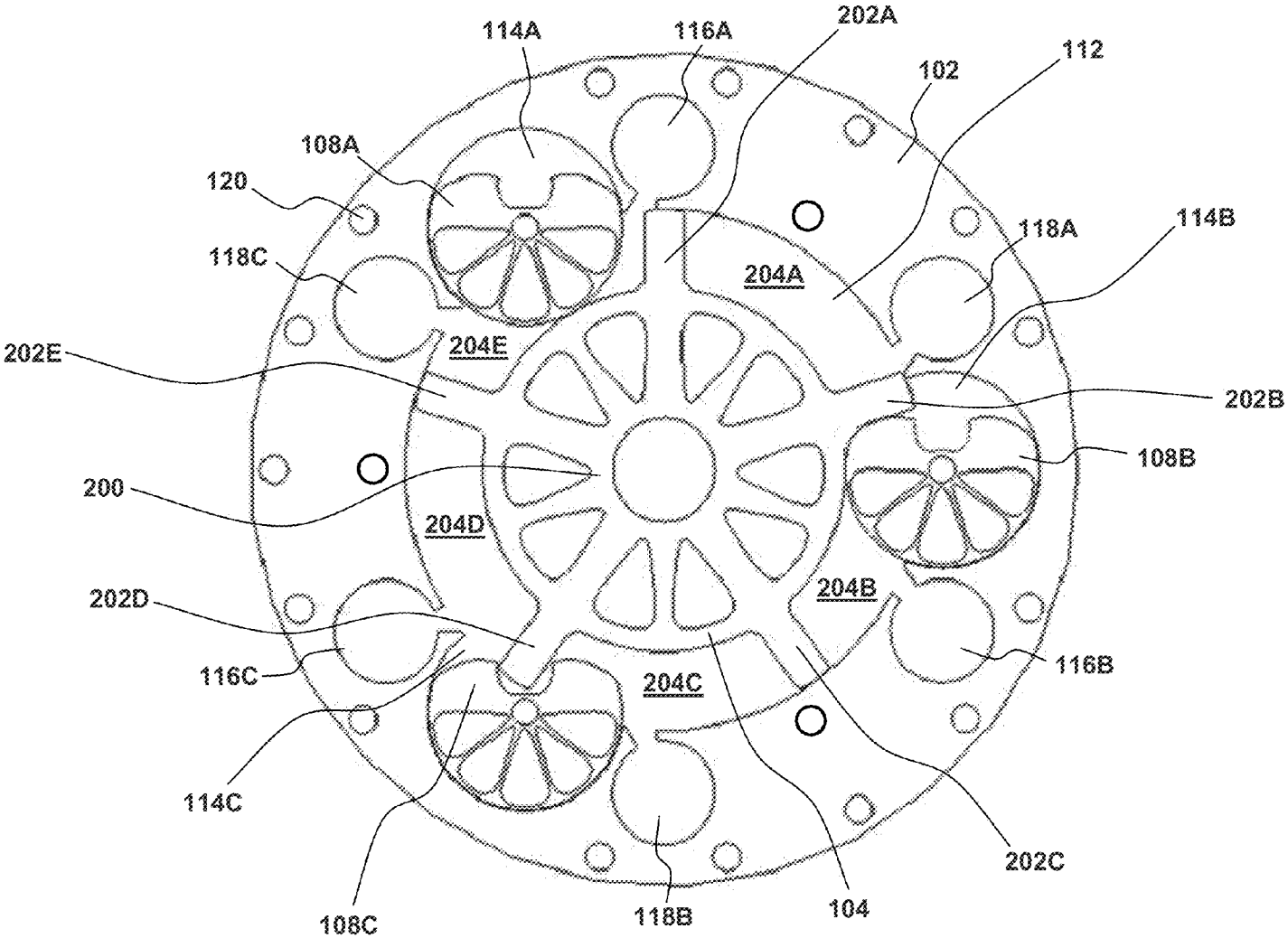
FIG. 2 is another sectional view of the rotary device of FIG. 1 illustrating the rotor encasement, primary rotor, and scavenging rotors of that rotary device.

As illustrated in FIG. 2, the primary rotor 104 comprises a circular main body 200 with a plurality of fixed vanes 202A-202E extending therefrom in a radial direction. The primary rotor 104 is rotatably disposed in the central opening 112 of the rotor encasement 102 such that a plurality of separate trapezoidal vane cells 204A-204E are formed between the main body 200 of the primary rotor 104, the vanes 202A-202E of the primary rotor 104, and the central opening 112 of the rotor encasement 102. Those vane cells 204A-204E vary in volume when the scavenging rotors 108A-108C move through the vane cells 204A-204E as the vanes 202A-202E rotate past them. When the primary rotor 104 rotates in the clockwise direction, for example, the volume of the second vane cell 204B increases as it moves past the second scavenging rotor 10813, and the volume of the third vane cell 204C decreases as it moves toward the third scavenging rotor 108C.

The primary rotor 104 is configured to rotate in response to pressure differences on opposing sides of the vanes 202A-202. Such pressure differences may be caused, for example, by expanding combustion gasses entering the central opening 112 of the rotor encasement 102 via the second intake opening 116B while cooling exhaust gases exit the central opening 112 of the rotor encasement 102 via the second exhaust opening 118B, thereby creating greater pressure in the second vane cell 204B than in the third vane cell 204C. Accordingly, that pressure differential causes the volume of the second vane cell 204B to increase and the volume of the third vane cell 204C to decrease, thereby causing the primary rotor 104 to rotate in a clockwise direction.

As also illustrated in FIG. 2, the scavenging rotors 108A-108C are rotatably disposed in the plurality of scavenging rotor openings 114A-114C of the rotor encasement 102 so as to rotate in place around the vanes 202A-202D of the primary rotor 104 with close tolerances as the vanes 202A-202D move through the locations of the scavenging rotors 108A-108C. Those close tolerances are configured to prevent leakage between the different vane cells 204A-204E, as well as between adjacent intake and exhaust openings (i.e., 116A and 118C, 116B and 118A, and 116C and 118B), as the vanes 202A-202E move past the scavenging rotors 108A-108C. And those close tolerances are achieved by shaping the both the primary rotor 104 and the scavenging rotors 108A-108C based on a plurality of intersecting curves that correspond to the multidirectional intersecting movement of both the scavenging rotors 108A-108C and the vanes 202A-202C as the scavenging rotors 108A-108C and the vanes 202A-202C move relative to one another.

The intake openings 116A-116C and exhaust openings 118A-118C are positioned immediately adjacent to the scavenging rotor openings 114A-114C on opposing sides thereof to maximize the volume of fluid that can be moved through each of the vane cells 204A-204E and to ensure that reverse pressure is not created at either the intake openings 116A-116C or the exhaust openings 118A-118C as the vanes 202A-202E move toward or away from them. If, for example, the second intake opening 116B and the second exhaust opening 118B were more centrally located more closely to each other in FIG. 2 further from the second scavenging rotor opening 114B and the third scavenging rotor opening 114C, respectively), then the vanes 202A-202E would create outward pressure at the second intake opening 116B as they moved away from the second scavenging rotor 108B and toward the second intake opening 116B, and they would create suction at the second exhaust opening 118B as they moved toward the third scavenging rotor 108C and away from the second exhaust opening 118B. Further, the intake openings 116A-116C and exhaust openings 118A-118C are spaced so that the vanes 202A-202E only allow fluid communication between one of those openings 116A-118C and each of the channels 204A-204E at any rotational position.

Figure 3:
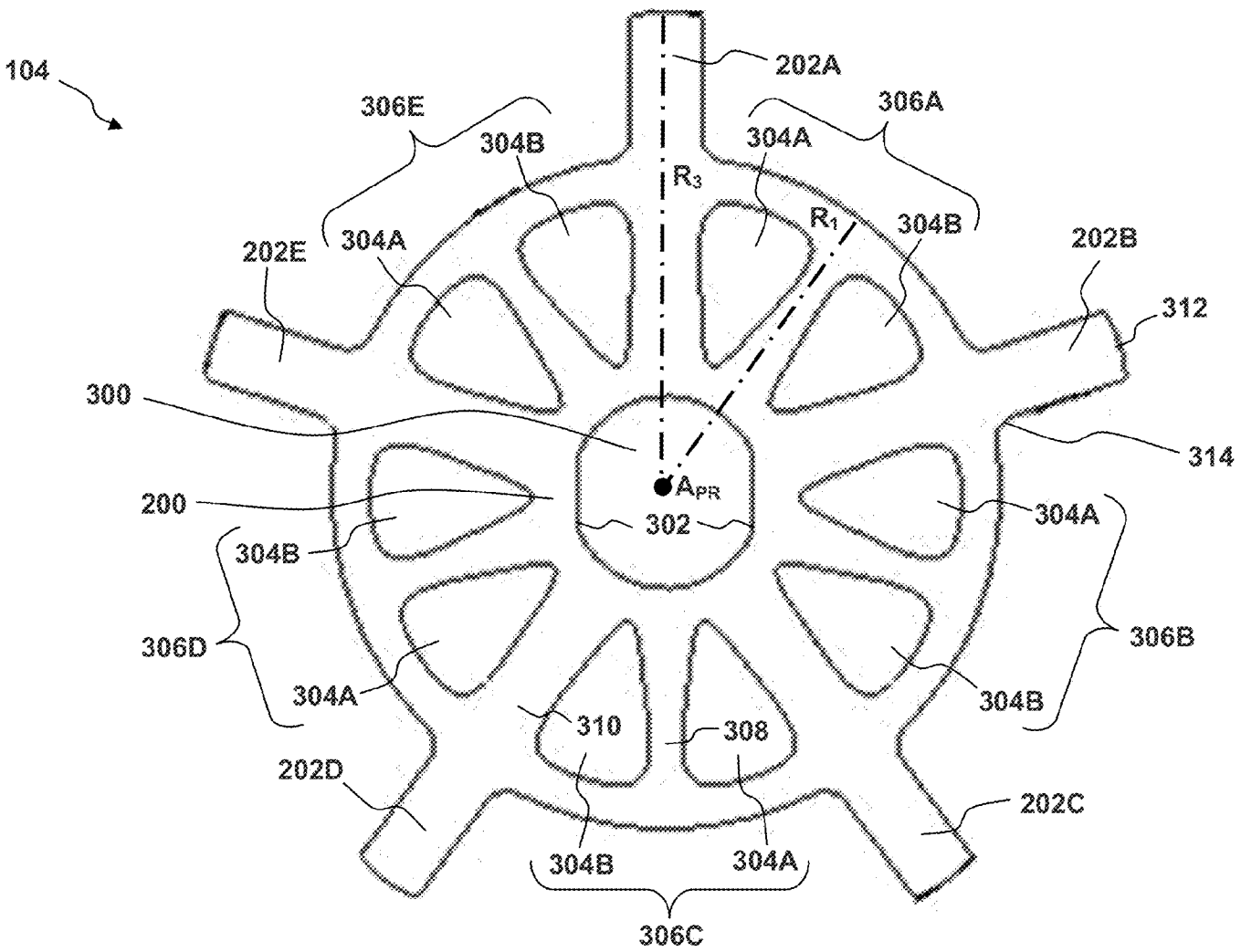
FIG. 3 is a plan view illustrating the primary rotor of FIG. 2.

Turning to FIG. 3, the main body 200 of the primary rotor 104 comprises a central bore 300 with a central axis $A_{PR}$ about which the primary rotor 104 is configured to rotate. The central bore 300 is formed concentrically about the axis of rotation $A_{PR}$ in a partial circle with substantially flat opposing sides 302. The central bore 300 comprises flat sides 302 to prevent rotation of the output shaft 710 (FIG. 7) within the central bore 300 when the output shaft 710 is being driven by the primary rotor 104. And those flat sides 302 are opposite each other to maintain an equal mass distribution on opposing sides of the axis of rotation $A_{PR}$ so as to prevent vibration when the primary rotor 104 rotates at high speeds. The vanes 202A-202E are equally spaced apart around the circumference of the main body 200 of the primary rotor 104 for similar reasons.

The main body 200 of the primary rotor 104 also comprises a plurality of teardrop shaped voids 304A and 304B disposed around the central bore 300. Although those voids 304A and 304B are positioned circumferentially around the central bore 300 in a configuration that maintains equal mass distribution about the axis of rotation $A_{PR}$, they are not equally spaced from another. Instead, the voids 304A and 304B are alternately spaced around so as to form a plurality of void pairs 306A-306E, such that a first spoke 308 is formed between the adjacent voids 304A and 304B in each of those void pairs 306A-306E and a second spoke 310 is formed between each of the adjacent void pairs 306A-306E. Further, the void pairs 306A-306E are provided in the same numbers as the vanes 202A-202E and are arranged so that the second spoke 310 between each of those void pairs 306A-306E is aligned with one of the vanes 202A, 202B, 202C, 202D, or 202E (referred to hereinafter as vane 202 when generally referring to one of the vanes 202A-202E).

The voids 304A and 304B are provided to reduce the mass, and therefore the moment of inertia, of the primary rotor 104. Each second spoke 310 is thicker in the circumferential direction than each first spoke 308 and is circumferentially aligned with a vane 202 so as to provide additional structural support to the primary rotor 104 that helps prevent the primary rotor 104 from expanding radially near the vanes 202A-202E at high rotational speeds due to the extra mass added by the vanes 202A-202E at those locations. Although the second spoke 308 also provides structural support to the primary rotor 104, it has less thickness than the second spoke 310 to further reduce the mass of the primary rotor 104 in locations that are less likely to expand during high rotational speeds.

Further, although the voids 304A and 304B are describes as having a teardrop shape, it should be understood that the voids 304A and 304B also may be formed in other shapes that achieve similar advantages. Moreover, rather than providing voids 304A and 304B, the primary rotor 104 may be formed utilizing different materials so as to reduce its mass in different locations. For example, the primary rotor 104 could be formed with a lighter material in the locations of the voids 404, or a lighter material could be placed into the voids 404, such as by injecting an aerogel into the voids 404.

The body 200 and vanes 202A-202E of the primary rotor 104 are configured to maintain close tolerances with the inner surface of the rotor encasement 102 and outermost surface 408 (FIG. 4) of the scavenging rotors 108A-108C as the primary rotor 104 rotates in the central opening 112 of the rotor encasement 102. More particularly, the outer surface of the body 200 (i.e., the surface at radius $R_1$) and the outermost surface 408 of the scavenging rotors 108A-108C (i.e., the surface at radius $R_2$) have diameters that result in the outer surface of the body 200 and the outermost surface 408 of the scavenging rotors 108A-108C rotating in close proximity to each other. And the outer surface of the vanes 202A-202E (i.e., the tips 312 of the vanes 202A-202E at radius $R_3$) and the inner surface of the rotor encasement 102 (i.e., the central opening 112) have diameters that result in the outer surface of the vanes 202A-202E moving in close proximity of the inner surface of the rotor encasement 102.

The tips 312 of the vanes 202A-202E, which correspond to the outermost surface of the primary rotor 104, are curved to conform to the curve of the inner diameter of the rotor encasement 102. The curve of the tips 312 have a radius that is less than the radius of the curve of the inner diameter of the rotor encasement 102 to provide additional clearance between the vanes 202A-202E and the inner diameter of the rotor encasement 102 at the outer edges of the tips 312 of the vanes 202A-202E. The close tolerance between those services helps create sonic conditions at the tips 312 of the vanes 202A-202E such that the flow of fluid past the tips 312 of the vanes 202A-202E is significantly limited. Such a condition is known as "choked flow."

The shoulders 314 of the primary rotor 104 where the vanes 202A-202E extend from the outer surface of the main body 200 are curved to conform to the shape of the intersected curves (FIG. 5, 500-504) at the leading and trailing edges (FIG. 4, 410 and 412) of the scavenging rotors 108A-108C to maintain close tolerances as the scavenging rotors 108A-108C move around the vanes 202A-202E. Those conforming curves are depicted, for example, between second scavenging rotor 108B and the shoulder 314 of the second vane 202B in FIG. 2. Conforming the shoulders 314 of the primary rotor 104 to the shape of the scavenging rotors 108A-108C in that manner prevents pockets from being created between the primary rotor 104 and the scavenging rotors 108A-108C that could carry fluid past the scavenging rotors 108A-108C as the scavenging rotors 108A-108C move around the vanes 202A-202E. Even if the sizes and dimensions of the primary rotor 104 and the scavenging rotors 108A-108C does not permit shaping the shoulders 314 of the primary rotor 104, the shoulders 314 of the primary rotor 104 still may be curved in a suitable manner to reduce stress concentrations and add strength where the vanes 202A-202E extend from the outer surface of the main body 200.

Figure 4:
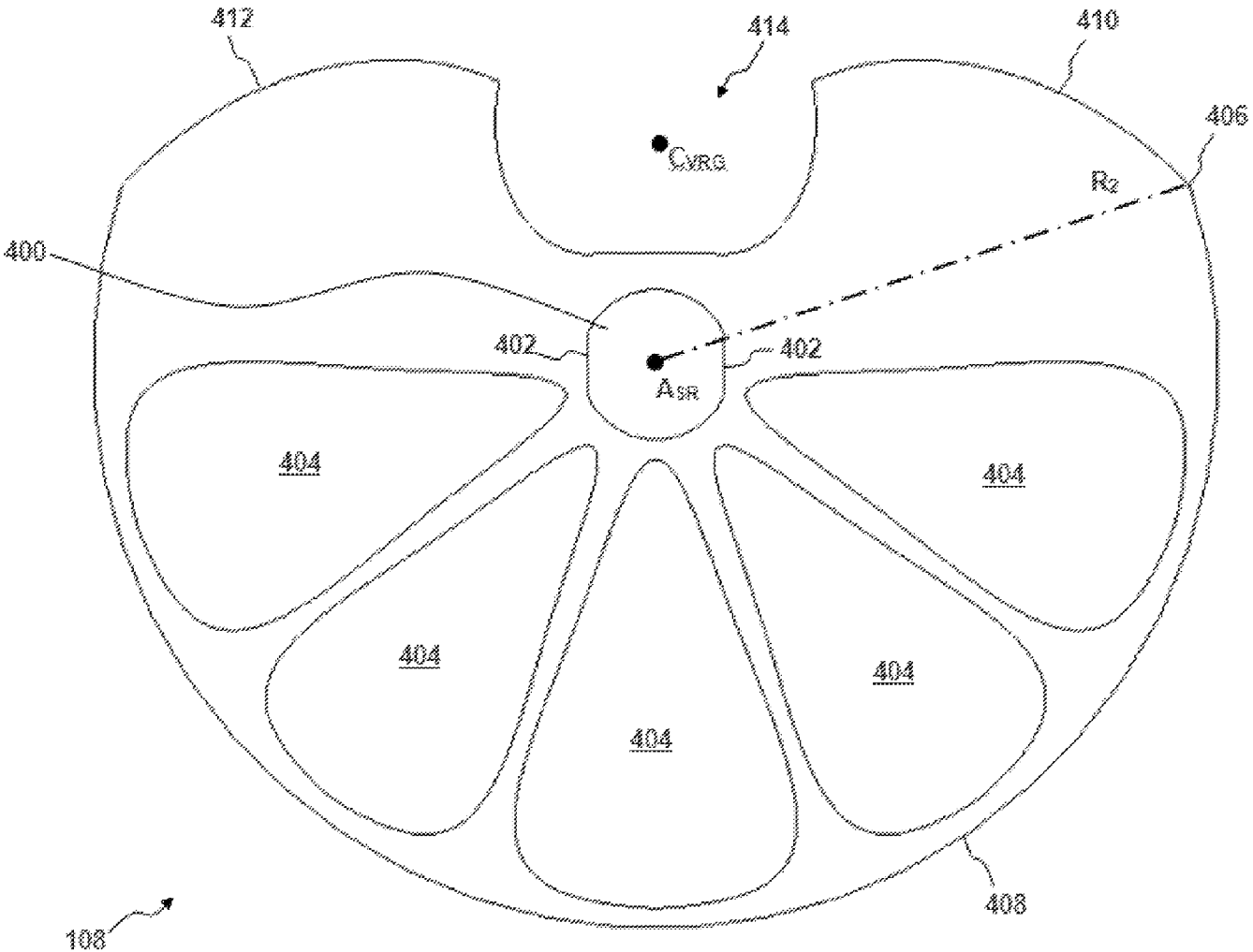
FIG. 4 is a plan view illustrating the scavenging rotor of FIG. 2.

Turning to FIG. 4, each of the scavenging rotors 108A-108C (referred to hereinafter as scavenging rotor 108 when generally referring to one of the scavenging rotors 108A-108C) comprises a central bore 400 with a central axis $A_{SR}$ about which the scavenging rotor 108 is configured to rotate. The central bore 400 is formed concentrically about the axis of rotation $A_{SR}$ in a partial circle with substantially flat opposing sides 402. The central bore 400 comprises flat sides 402 to prevent rotation of the shaft (not shown) that connects the scavenging rotors 108A-108C to their respective secondary gears 110A-110C within the central bore 400 when the secondary gears 110A-110C are driving the scavenging rotors 108A-108C. And those flat sides 402 are opposite each other to maintain an equal mass distribution on opposing sides of the axis of rotation $A_{SR}$ so as to prevent vibration when the scavenging rotor 108 rotates at high speeds.

The scavenging rotor 108 also comprises a plurality of teardrop shaped voids 404 disposed on one side of the axis of rotation $A_{SR}$. Those voids 404 are provided to offset the mass removed from the scavenging rotor 108 on the opposing side of the axis of rotation $A_{SR}$ to maintain an equal mass distribution on opposing sides of the axis of rotation $A_{SR}$ so as to further prevent vibration when the scavenging rotor 108 rotates at high speeds. Moreover, those voids 404 reduce the mass, and therefore the moment of inertia, of the scavenging rotor 108. Material is removed from the side of the scavenging rotor 108 opposite the voids 404 so that the scavenging rotor 108 may move around the vanes 202A-202E without contacting them as the vanes 202A-202E moves past the scavenging rotors 108 and the scavenging rotor 108 rotates. Accordingly, material may be removed from the scavenging rotor 108 in amounts and in locations sufficient to offset the volume of material removed to shape the opposing side of the scavenging rotor 108. And by removing material further from the axis of rotation $A_{SR}$ of the scavenging disc 108 to form the voids 404, less material may be removed to offset the volume of material removed to shape the opposing side of the scavenging rotor 108.

Figure 5:
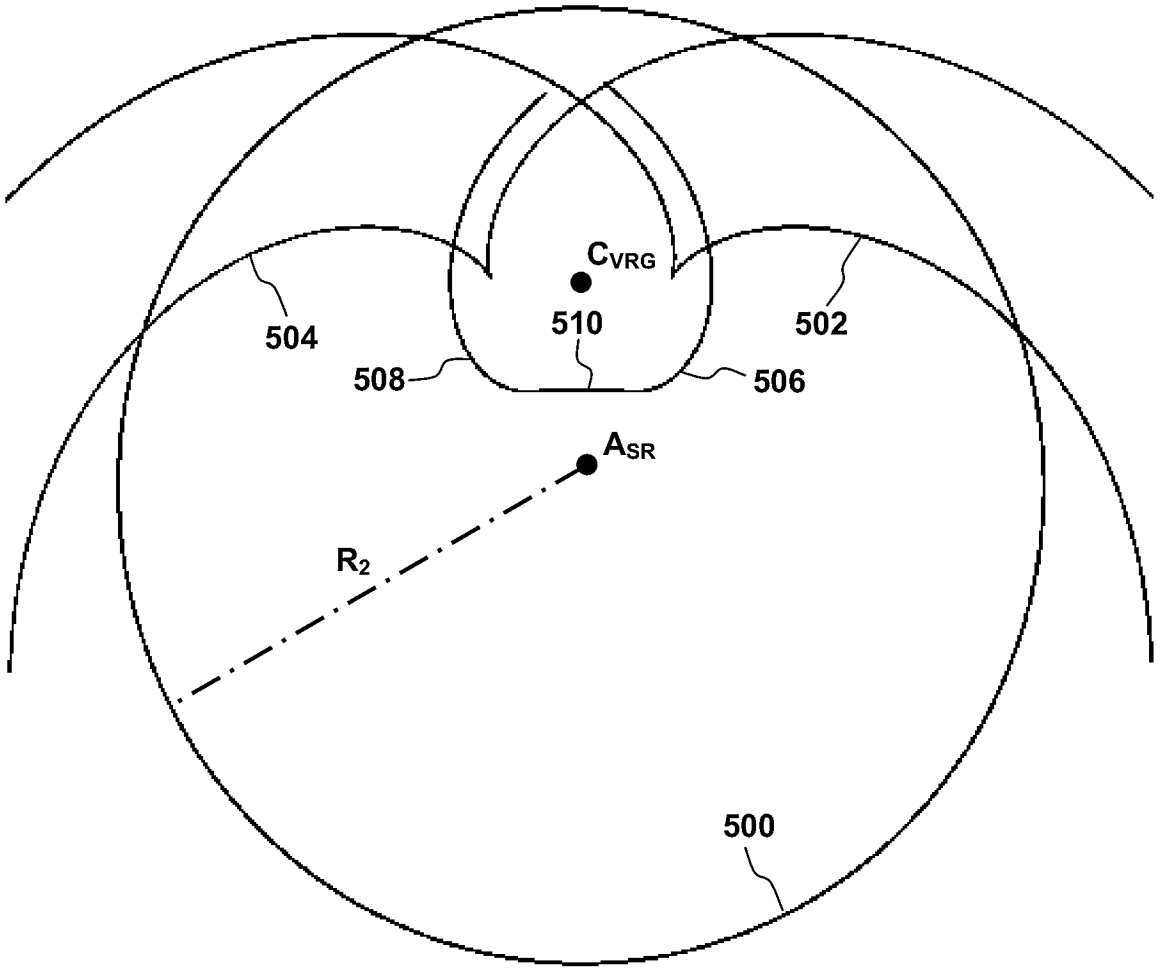
FIG. 5 is a plot illustrating the curves that are used form the scavenging rotor of FIG. 4 according to a non-limiting embodiment of the disclosure.

As illustrated in FIG. 5, the shape of each of the scavenging rotor 108 is defined by a plurality of intersecting curves 500-510 that correspond to the multidirectional intersecting movement of both the scavenging rotor 108 and a vane 202 as the scavenging rotor 108 and primary rotor 104 rotate relative to one another. The first curve 500 corresponds to the circumference of a circle defined by the outermost radial point 406 (i.e., radius $R_2$) of the scavenging rotor 108 from its axis of rotation $A_{SR}$ as it rotates around that axis of rotation $A_{SR}$. Accordingly, the first curve 500 forms the outermost surface 408 of the scavenging rotor 108, to which reference is made above. The second curve 502, third curve 504, fourth curve 506, fifth curve 508, and sixth curve 510 correspond to the movement of different portions of a vane 202 as the primary rotor 104 rotates, taken relative to the rotation of the scavenging rotor 108.

The second curve 502, third curve 504, fourth curve 506, fifth curve 508, and sixth curve 510 are generated by determining the multidirectional intersecting movement of a vane 202 from the reference point of the axis of rotation $A_{SR}$ of the scavenging rotor 108. More particularly, both the rotation of the scavenging rotor 108 and the rotation of the vane 202 are taken into consideration to ensure that, as the primary rotor 104 and scavenging rotor 108 rotate, no point on the scavenging rotor 108 rotates through the same point through which a vane 202 rotates at the same point in time. Both of those rotational movements are translated into a set of curves 502-510 by plotting the movement of a vane 202 with respect to the axis of rotation $A_{SR}$ of the scavenging rotor 108 such that the primary rotor 104 appears to be rotating about the axis of rotation $A_{SR}$ of the scavenging rotor 108 as it also rotates about its own axis of rotation $A_{PR}$. The resulting multidirectional movement of a vane 202 is depicted, for example, in FIG. 6.

Figure 6:
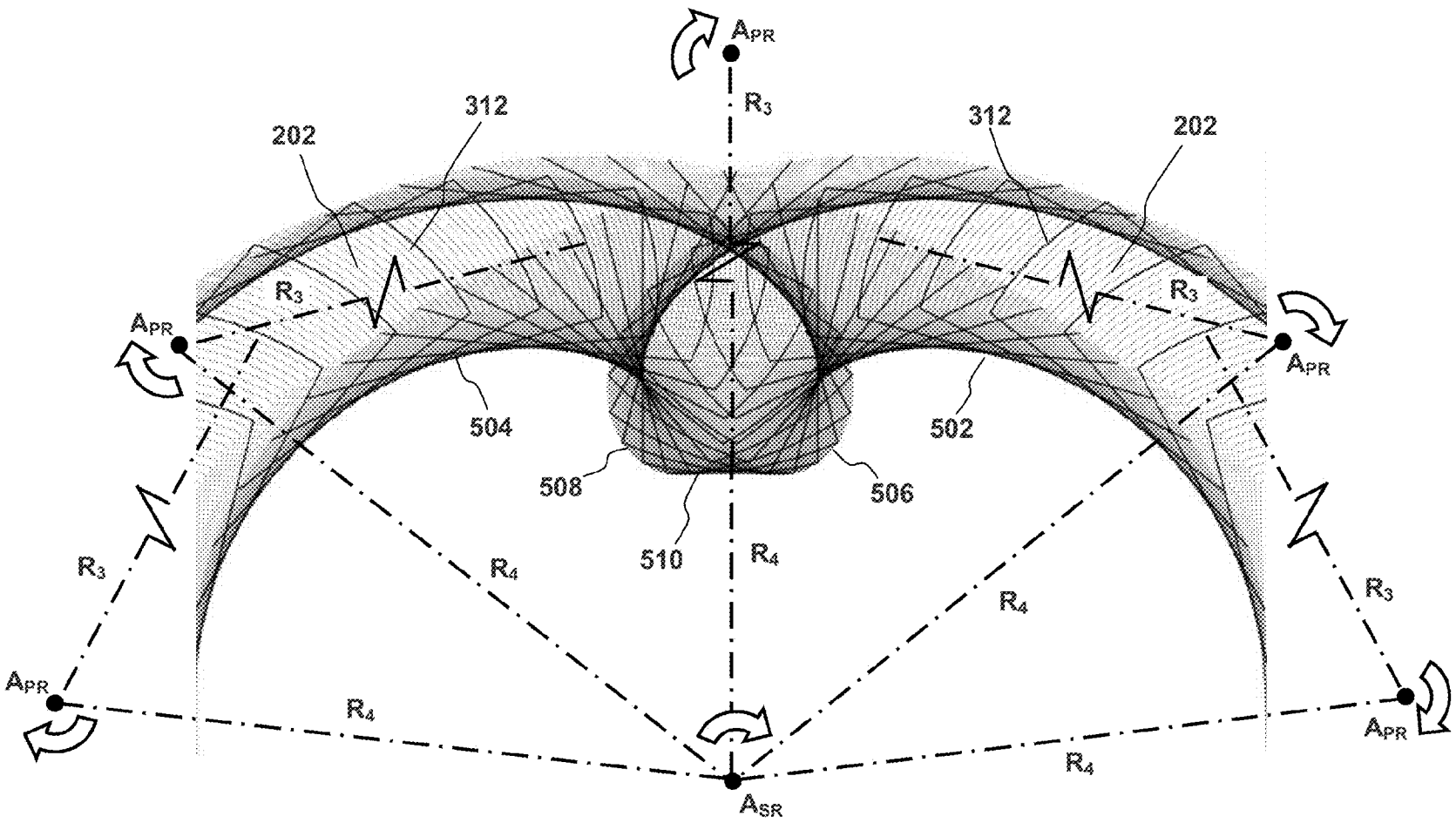
FIG. 6 is a plot illustrating the multidirectional and intersecting movement of both the scavenging rotor of FIG. 4 and a vane of the primary rotor of FIG. 3 that are used to form the curves of FIG. 5 according to a non-limiting embodiment of the disclosure.

As illustrated in FIG. 6, the second curve 502, third curve 504, fourth curve 506, fifth curve 508, a sixth curve 510 are generated by rotating the axis of rotation $A_{PR}$ of the primary rotor 104 about the axis of rotation $A_{SR}$ of the scavenging rotor 108 and simultaneously rotating the silhouette of the vane 202 about the axis of rotation $A_{PR}$ of the primary rotor 104 (i.e., rotating the primary rotor 104 about radius $R_4$ as the primary rotor 104 rotates about its own axis of rotation $A_{PR}$). Such planetary motion also may be replicated in other manners. For example, the axis of rotation $A_{SR}$ of the scavenging rotor 108 may be rotated about the axis of rotation $A_{PR}$ of the primary rotor 104 while simultaneously rotating the scavenging rotor 108 about its own axis of rotation $A_{SR}$ (i.e., by rotating the primary rotor 104 about radius $R_4$ as the primary rotor 104 rotates about its own axis of rotation $A_{PR}$). Or such planetary motion may be replicated by rotating the scavenging rotor 108 about its own axis of rotation $A_{SR}$ while simultaneously rotating the primary rotor about its own axis of rotation $A_{PR}$. Nevertheless, it should be understood that it is computationally more simple to utilize either the axis of rotation $A_{PR}$ of the primary rotor 104 or the axis of rotation $A_{SR}$ of the scavenging rotor 108 as a point of reference for both rotations.

Those rotations are performed at rotational speeds with the same ratio as the rotational speeds at which the primary rotor 104 and the scavenging rotor 108 rotate relative to one another, if for example, in a configuration with (5) vanes 202A-202E on the primary rotor 104, the primary rotor 104 rotates with a rotational speed that is five (5) times less than the rotational speed of the scavenging rotor 108, such that each vane 202 is rotated about the axis of rotation $A_{PR}$ of the primary rotor 104 at a rotational speed that is five (5) times less than the rotational speed at which the axis of rotation $A_{PR}$ of the primary rotor 104 is rotated about the axis of rotation $A_{SR}$ of the scavenging rotor 108. The resulting curves 502-510 thereby represent the multidirectional intersecting movement of the scavenging rotor 108 and the vane 202 with respect to one another at the appropriate rotational speeds.

As the axis of rotation $A_{PR}$ of the primary rotor 104 is rotated about the axis of rotation $A_{SR}$ of the scavenging rotor 108 and the vane 202 is simultaneously rotated about the axis of rotation $A_{PR}$ of the primary rotor 104, the trailing edge of the vane 202 (i.e., the edge of the vane 202 moving away from the scavenging rotor 108) sweeps the second curve 502, the leading edge of the vane 202 (i.e., the edge of the vane 202 moving toward the scavenging rotor 108) sweeps the third curve 504, the leading outer edge of the tip 312 of the vane 202 sweeps the fourth curve 506, the trailing outer edge of the tip 312 of the vane 202 sweeps the fifth curve 508, and the curved upper surface of the tip 312 of the vane 202 sweeps the fifth curve 510. Because those curves 502-510 are formed with the axis of rotation $A_{SR}$ as the point of reference, they may be superimposed directly over the first curve 500, which has the same axis of rotation $A_{SR}$, as depicted in FIG. 5. The area of the first curve 500 that falls outside of those curves 502-510 then may be subtracted from the first curve to form the shape of the scavenging rotor 108, as depicted in FIG. 4.

It is the area of the first curve 500 that falls outside of those curves 502-510 that is referred to above as being "removed" from the scavenging rotor 108 and offset by the voids 404. Nevertheless, it should be understood that the scavenging rotor 108 need not be formed in the same manner as the curves 500-510 that define it. More specifically, the scavenging rotor 108 need not be formed as a circle with the same diameter as the first curve 500 and subsequently machined or otherwise treated to remove the material that corresponds to the area that falls outside of the second curve 502, third curve 504, fourth curve 506, fifth curve 508, and sixth curve 510. Instead, the scavenging rotor 108 may be machined to its final shape without first forming a circle with the same diameter as the first curve 500 so as to reduce material waste. The scavenging rotor 108 also may be formed in its final shape by any other suitable method, such as casting.

Returning to FIG. 4, the second curve 502 and third curve 504 form the leading edge 410 (i.e., the edge of the scavenging rotor 108 that moves toward the body 200 of the primary rotor 104) and the trailing edge 412 (i.e., the edge of the scavenging rotor 108 that moves toward the body 200 of the primary rotor 104) of the scavenging rotor 108. And the fourth curve 506, fifth curve 508, and sixth curve 510 form a vane-receiving groove 414. The first curve 502 and second curve 504 curve outward away from the axis of rotation $A_{SR}$ of the scavenging rotor 108 so as to open inward toward the axis or rotation $A_{SR}$ of the scavenging rotor 108 in a concave manner; the fourth curve 506 and fifth curve 406 curve outward away from the center of the vane-receiving groove 414 $C_{VRG}$ so as to open inward toward in the center of the vane receiving groove in a concave manner; and the sixth curve 510 curves outward away from the center of the vane-receiving groove 414 $C_{VRG}$ so as to open outward away from the center of the vane-receiving groove 414 $C_{VRG}$ in a concave manner.

The curved shapes of the second curve 502 and third curve 504 form shoulders on opposing sides of the vane-receiving groove 414 that allow the leading edge 410 and trailing edge 412 of the scavenging rotor 108 to maintain close tolerances with the trailing edges and leading edges of the vanes 202A-202E as the scavenging rotor 108 rotates around the vanes 202A-202E. The curved shapes of the third curve 506 and fourth curve 508 form the sides of the vane-receiving groove 414 and allow the sides of the receiving groove to maintain close tolerances with the leading outer edge of the tip 312 of the vanes 202A-202E and the trailing outer edge of the tip 312 of the vanes 202A-202E as the scavenging rotor 108 rotates around the vanes 202A-202E. And the curved shape of the fifth curve 510 forms a dimple at the bottom of the vane-receiving groove 414 that allows the bottom of the vane-receiving groove 414 to maintain close tolerances with the curved upper surface of the tip 312 of the vanes 202A-202E as the scavenging rotor 108 rotates around the vanes 202A-202E. Together, the first curve 502, second curve 504, third curve 506, fourth curve 508, and fifth curve 510 allow the scavenging rotor 108 to maintain close tolerances with the vanes 202A-202E as the scavenging rotor 108 rotates around the vanes 202A-202E. Similarly, the outermost surface 408 of the scavenging rotor 108 maintains close tolerances with the body 200 of the primary rotor 104 as the scavenging rotor 108 rotates adjacent to the portions of the body 200 of the primary rotor 104 in between the vanes 202A-202E.

To provide the correct timing for the scavenging rotors 108A-108C to move around the vanes 202A-202E as the vanes 202A-202E move past the scavenging rotors 108A-108C, the primary gear 106 has more teeth than each of the secondary gears 110A-110C by a factor equivalent to the number of vanes 202A-202E on the primary rotor 104 such that the scavenging rotors 108A-108C make one full revolution for each vane 202A-202E on the primary rotor 104 per revolution of the primary rotor 104. In FIG. 2, for example, there are five (5) vanes 202A-202E, so the gear ratio of the primary gear 106 to each of the secondary gears 110A-110C is 5:1. Thus, each of the scavenging rotors 108A-108C rotates five (5) times for every one (1) rotation of the primary rotor 104. And with each of those five (5) rotations, each of the scavenging rotors 108A-108C moves around one of the vanes 202A-202E.

To provide close tolerances between the scavenging rotors 108A-108C and the vanes 202A-202E, rather than a contact fit, the curve of the tip 312 of the vanes 202A-202E and the leading and trailing edges of the vanes 202A-202E may shifted outward by an appropriate amount so that the size of the silhouette of the vanes 202A-202E that is swept through the scavenging rotors 108A-108C is increased. The enlarged silhouette then may be utilized when calculating the shape of the second curve 502, third curve 504, fourth curve 506, fifth curve 508, and sixth curve 510. In the alternative, the second curve 502, third curve 504, fourth curve 506, fifth curve 508, and sixth curve 510 may be shifted inward in a similar manner. And as yet another alternative, both that outward shift and that inward shift may be performed. For example, to obtain a tolerance of 0.001 inches, the curve of the tip 312 of the vanes 202A-202E and the leading and trailing edges of the vanes 202A-202E may shifted outward 0.0005 inches, and the second curve 502, third curve 504, fourth curve 506, fifth curve 508, and sixth curve 510 may be shifted inward 0.0005 inches.

The close tolerances between the primary rotor 104 and the scavenging rotors 108A 108C provide non-contact interfaces that prevent leakage within the rotary device 100. As described above, those non-contact interfaces operate as a non-contact seals by creating a choked flow condition between the primary rotor 104 and the scavenging rotors 108A-108C. Similarly, the central opening 112 and the plurality of scavenging rotor openings 114A-114C of the rotor encasement 102 are toleranced with respect to the vanes 202A-202E of the primary rotor 104 and the outermost surface 408 of the scavenging rotors 108A-108E to create a choked flow condition between the rotor encasement 102 and the primary rotor 104 and between the rotor encasement 102 and the scavenging rotors 108A-108C.

By utilizing non-contact interfaces to create non-contact seals between the various moving parts of the rotary device 100, the compressor can operate more efficiently with less frictional loses, which eliminates the need for lubricants and allows the rotary device 100 to operate at higher temperatures than compressors that utilize oil-based lubricants and/or contact seals. The rotary device 100 also may operate without rollers at the tips 312 of the vanes 202A-202E and without wet or dry lubrication. Moreover, the body 200 of the primary rotor 104 and the outermost surface 408 of the scavenging rotors 108A-108C may be sized irrespective of their surface speeds the rate of movement at their respective circumferences) as long as their rotational speeds (i.e., the rate at which they rotate about their central axes $A_{PR}$ and $A_{SR}$) are accounted for when calculating the shape of the second curve 502, third curve 504, fourth curve 506, fifth curve 508, and sixth curve 510.

In FIG. 2, for example, the primary rotor 104 rotates with a rotational speed that is five (5) times less than the rotational speed of the scavenging rotors 108A-108C. Nevertheless, the radius of the main body 200 of the primary rotor 104 (i.e., radius $R_1$) need not be five (5) times greater than the radius of the outermost surface 408 of the scavenging rotors 108A-108C (i.e., radius $R_2$) in order to maintain the same surface speed because there is not contact between the outer surfaces of those components of the rotary device 100. Instead, by utilizing the foregoing method to define the shape of the scavenging rotors 108A-108C so that they move around the vanes 202A-202E, the radius of the outer surface 408 of the scavenging rotors 108A-108C may be selected independently of the radius of the main body 200 of the primary rotor 104, and vice versa, thereby allowing for flexibility of design of the rotary device 100, such as the volume of the working area between the scavenging rotors 108A-108C. The rotary device 100 also allows for flexibility of design in terms of the number of scavenging rotors 108A-108*n*, and therefore working areas, are provided in the rotary device 100.

Returning to FIG. 2, there are three (3) working areas defined between the three (3) scavenging rotors 108A-108C. The first working area is defined by the area in the central opening 112 of the rotor encasement 102 between the primary rotor 104, the first scavenging rotor 108A, and the second scavenging rotor 108B and comprises the first intake opening 116A and the first exhaust opening 118A; the second working area is defined by the area in the central opening 112 of the rotor encasement 102 between the primary rotor 104, the second scavenging rotor 108B, and the third scavenging rotor 108C and comprises the second intake opening 116B and the second exhaust opening 118B; and the third working area is defined by the area in the central opening 112 of the rotor encasement 102 between the primary rotor 104, the third scavenging rotor 108C, and the first scavenging rotor 108A and comprises the third intake opening 116C and the third exhaust opening 118C. Each of those working areas may be utilized as either a fixed-vane compressor or a fixed-vane expander.

Figure 7:
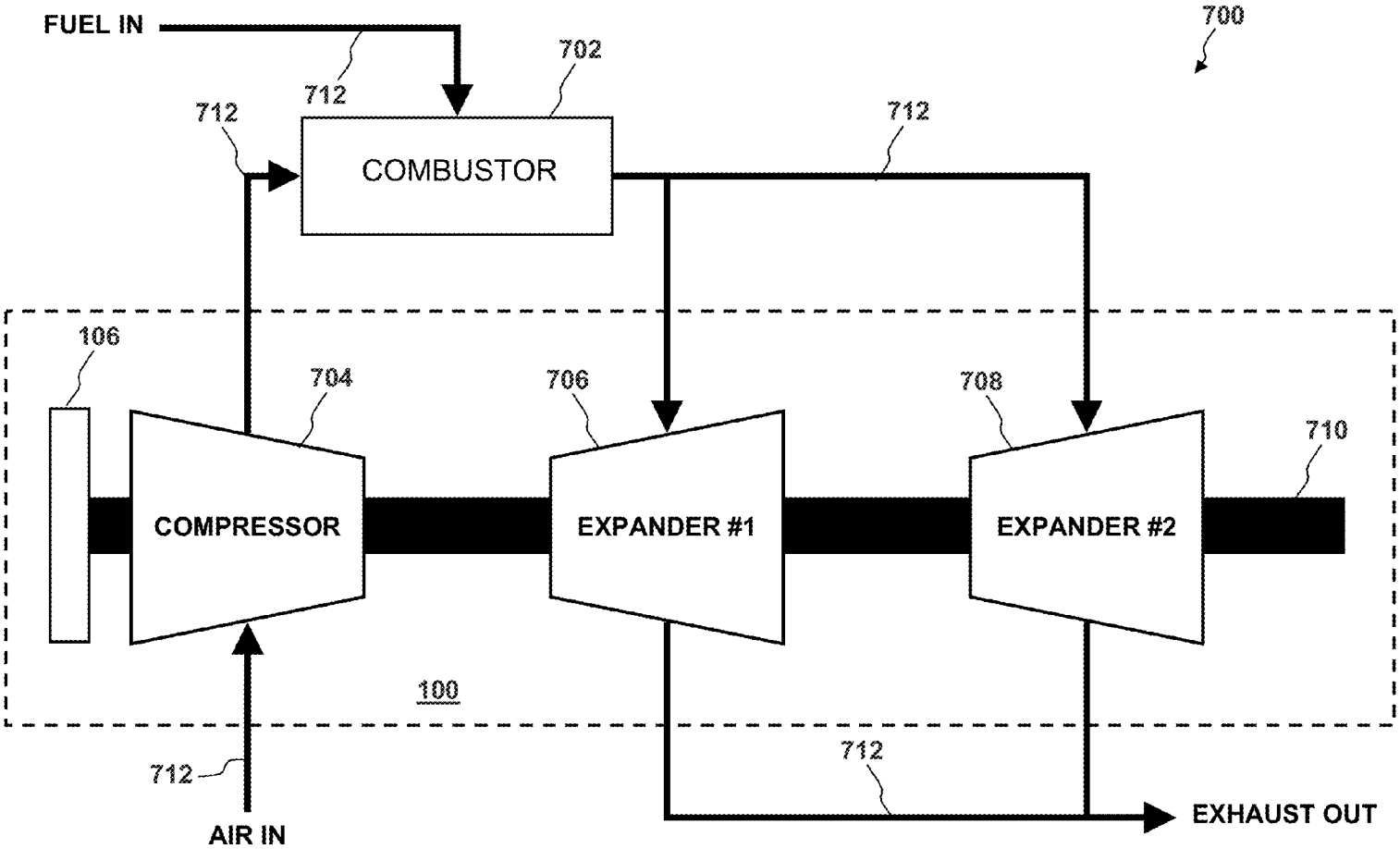
FIG. 7 is a schematic diagram illustrating a Brayton-cycle engine that utilizes the rotary device of FIG. 1 according to a non-limiting embodiment of the disclosure.

Turning to FIG. 7, an example of how the three (3) working areas of the rotary device 100 of FIG. 1 may be utilized in an Brayton-cycle engine 700 is illustrated. The engine 700 comprises the rotary device 100 and a combustor 702. The combustor 702 comprises various components to facilitate the combustion of fuel in the presence of air, such as provisions for fuel injection and ignition. The rotary device 100 is configured to extract energy from substantially any type of expanding fluid. Accordingly, the combustor 702 may be configured to combust substantially any type of fuel.

In the rotary device 100, the first working area is utilized as a fixed-vane compressor 704, the second working area is utilized as a first fixed-vane expander 706, and the third working area is utilized as a second fixed-vane expander 708. The compressor 704, first expander 706, and second expander 708 share the same output shaft 710 by virtue of the first working area, second working area, and third working area each being configured to generate positive displacement via the same primary rotor 104, which is attached to the output shaft 710. The primary gear 106 also is attached to the output shaft 710.

The combustor 702, the compressor 704, the first expander 706, and the second expander 708 are in fluid communication with each other via piping 712 such that fuel and air may be input into the engine 700 upstream of the combustor 702 and the compressor 704, respectively, and exhaust may be output from the engine 700 downstream of the first expander 706 and the second expander 708. That piping 712 may comprise, for example, tubes attached to ports in the rotor encasement 102 and/or channels formed in the rotor encasement 102 such that the fluid communication between those components of the rotary device 100 is provided outside of the working areas. As described above, fluid communication between the working areas is substantially prevented by the non-contact seals created by the close tolerances with which the components of the rotary device 100 are manufactured.

The compressor 704 is configured to charge the combustor 702 with air; the combustor 702 is configured to combust fuel and air; and the first expander 706 and the second expander 708 are configured to extract energy from the combusted fuel and air as those hot gases expand, Accordingly, the combustor 702 is disposed downstream of the compressor 704 and upstream of the first expander 706 and the second expander 708. The energy extracted by the first expander 706 and the second expander 708 is used to drive the compressor 704, which compresses the air so that it may be mixed with the fuel and combusted in the combustor 702. Then, as the combusted fuel exits the combustor 702 through the first expander 706 and the second expander 708, it causes the first expander 706 and the second expander 708 to rotate. The rotation of the first expander 706 and the second expander 708 then drives the output shaft 710.

Because the compressor 704, the first expander 706, and the second expander 708 share a common primary rotor 104, the rotation of the primary rotor 104 that is caused by the expansion of hot gases in the first expander 706 and second expander 708 directly drives the compressor 704 via the primary rotor 104, rather than via the output shaft 710. And the engine 700 utilizes more expanders than compressors so that there is greater displacement in the expanders, such that air and fuel move through the engine 700 in the proper direction.

Although the embodiments depicted in FIGS. 1-7 comprise one (1) compressor 704 and two (2) expanders 706 and 708, it should be understood that other numbers of compressors and expanders may be utilized to optimize the flow of fuel and air through the engine 700. It also should be understood that those different numbers of compressors and expanders may be obtained by utilizing two or more rotary devices 100, or by modifying the rotary device 100 to include a larger number of working areas (i.e., a larger number of scavenging rotors 108A-108C and vanes 202A-202E). Further, it should be understood that the desired displacement may be obtained by increasing the size of a working area compared to another, rather than providing different numbers of working areas.

The rotation of the primary rotor 104 also drives the output shaft 710, which drives the primary gear 106. The rotation of the primary gear 106 drives the scavenging rotors 108A-108C via, the secondary gears 110A-110C. The energy extracted from the combusted fuel is utilized not only to drive the first expander 706 and the second expander 708, it also is utilized to drive other machinery that may be connected to the output shaft 710. Accordingly, the engine 700 is configured to operate similarly to a turboshaft, wherein the first expander 706 and second expander 708 operate similarly to the turbine section of a gas turbine. The first expander 706 and the second expander 708, however, are positive displacement devices, rather than dynamic devices, such that they are not subject to the operational limitations generally associated with gas turbines. In particular, the configuration of the first expander 706 and the second expander 708 allow the rotary device 100 to remain efficient at operating speeds that are similar to the effective speeds of the compressor.

Because the disclosed rotary device 100 is may operate as a positive displacement engine, it has a broader speed range than turbines, which are subject to the laws which govern fans. Like a reciprocating engine, the maximum power speed of the disclosed rotary device 100 may be a large multiple of its idle speed. The ability to idle at partial power and low fuel consumption is a distinct advantage that reciprocating engines have over gas turbines in automotive applications.

The compressor 704 also is a positive displacement device, rather than a dynamic device. Thus, the compressor 704 operates similarly to a Roots blower, wherein the backpressure in the rotary device 100, as compared to the atmospheric pressure of the air input from upstream of the compressor 704, allows the compressor 704 to generate a pressure rise in the air as it passes through the compressor 70. Moreover, the compressor 704 also allows the rotary device 100 to remain efficient at operating speeds that are closer to its design speeds due to its positive displacement configuration. The ability of both the compressor 704 and the first expander 706 and second expander 708 to operate efficiently at such high operational speeds is of particular importance in the rotary device 100 because the compressor 704, first expander 706, and second expander 708 share the same primary rotor 104.

In operation, an open Brayton cycle may be performed with the engine 700. Air is pulled into the compressor 704 via piping 712 that places the first intake opening 116A in fluid communication with atmosphere. The compressor 704 outputs the compressed air to the combustor 702 via piping 712 that places the first exhaust opening 118A in fluid communication with an input of the combustor 702. The combustor 702 also is in fluid communication with a fuel source (e.g., a fuel tank) via the piping 712. Fuel is input into the combustor 702 from the fuel source, such as via a fuel injector, and mixed with the compressed air from the compressor 704 before being combusted. Through those interfaces, the compressor 704 is able to facilitate continuous combustion in the combustor 704 at near-constant pressure.

As the combusted fuel expands, it moves into the first expander 706 and the second expander 708 via piping 712 that places an output of the combustor 702 in fluid communication with the second intake opening 116C and second intake opening 116C. That expanding gas moves toward the first expander 706 and the second expander 708, rather than toward the compressor 704, due to the larger displacement of the first expander 706 and the second expander 708 generated by providing a larger number of expanders than compressors. And to prevent uneven distribution of the expanding gases between the first expander 706 and the second expander 708, the piping 712 that places those components in fluid communication with the combustor 702 is of the appropriate sizes and lengths to maintain equivalent flow of those expanding gases through the first expander 706 and the second expander 708. The piping 712 through which those gases area exhausted from the first expander 706 and the second expander 708 also is of the appropriate sizes and lengths to maintain equivalent flow through the first expander 706 and the second expander 708.

The first expander 706 and the second expander 708 extract energy from the expanding gases as those gases move through the first expander 706 and the second expander 708. While some of that energy is utilized to drive the compressor 704 and the primary gear 106, the remaining energy may be utilized to drive machinery attached to the output shaft 710. The configuration of the rotary device 100 allows such energy to be efficiently extracted from the output shaft 710 by utilizing positive displacement devices are for both the compressor and the power extraction roles. Moreover, it eliminates the need for lubrications that might limit the operating temperatures of the rotary device.

In addition, although the disclosed embodiments are described above as being used to implement a Brayton cycle to drive other machinery with the rotary device via output shaft 710, they also may be implemented in a reverse Brayton cycle, or Bell Coleman cycle, by driving the rotary device 100 via the output shaft 710. In such an implementation, the combustor 702 may be replaced with an evaporator and cooled fluid may be moved through an evaporator before being returned back to the compressor 704, rather than being exhausted to atmosphere. Such a closed, reverse Brayton cycle may, for example, be utilized to refrigerate air.

The foregoing description and drawings should be considered as illustrative only of the principles of the invention. The invention may be configured in a variety of shapes and sizes and is not intended to be limited by the preferred embodiments. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A rotary device comprising:

a rotor encasement comprising a central opening;

a first rotor rotatably disposed within the central opening, the first rotor comprising a substantially circular main body and two or more protrusions extending radially from the main body, each protrusion comprising a leading side and a trailing side opposite the leading side, at least a pair of voids being provided in the main body between each adjacent pair of the two or more protrusions, and each pair of voids being spaced from each adjacent pair of voids by a distance greater than that between each adjacent void in each pair of voids; and one or more second rotors rotatably disposed at an edge of the central opening so that at least a portion of each of the one or more second rotors extends radially into the central opening, each of the one or more second rotors comprising:

a first curved surface that is configured to move adjacent to the main body of the first rotor between the protrusions as the first rotor and one or more second rotors rotate relative to one another;

a protrusion-receiving groove extending into the one or more second rotors that is configured to receive one of the plurality of protrusions therein so that at least a tip of the one protrusion moves adjacent to the protrusion-receiving groove as the first rotor and one or more second rotors rotate relative to one another; and a second curved surface and a third curved surface extending away from a center of the protrusion-receiving groove on opposing sides of the protrusion-receiving groove that are configured to move adjacent to the leading side and the trailing side of the one protrusion, respectively.

2. The rotary device of claim 1, wherein:

the adjacency of the main body of the first rotor and the first curved surface of the one or more second rotors provides a non-contact seal between the main body of the first rotor and the first curved surface of the one or more second rotors;

the adjacency of at least the tip of the one protrusion and the protrusion-receiving groove provides a non-contact seal between at least the tip of the one protrusion and the protrusion-receiving groove; and the adjacent of at least the leading and trailing sides of the one protrusion and the second and third curved surfaces provide a non-contact seal between at least the leading and trailing sides of the one protrusion and the second and third curved surfaces.

3. The rotary device of claim 2, wherein the protrusion-receiving groove is configured to provide at least two points of adjacency when at least opposing edges of the tip of the one protrusion are received therein.

4. The rotary device of claim 3, wherein:

the second curved surface is configured to provide at least one point of adjacency with the leading side of the one protrusion while the first curved surface provides at least one point of adjacency with the main body of the first rotor; and the third curved surface is configured to provide at least one point of adjacency with the trailing side of the one protrusion while the first curved surface provides at least one point of adjacency with the main body of the first rotor.

5. The rotary device of claim 1, wherein:

the first rotor comprises five or more protrusions; and three or more second rotors are rotatably disposed at an edge of the central opening.

6. The rotary device of claim 1, wherein:

two or more second rotors are rotatably disposed at an edge of the central opening; and the rotor encasement comprises an intake port and an exhaust port between each adjacent pair of the two or more second rotors such that at least two areas are provided between each adjacent pair of the two or more second rotors and each of the at least two areas may be is configured to be utilized as either a compressor or expander as fluid enters the intake port and exits the exhaust port in that area.

7. The rotary device of claim 1, wherein:

the first curved surface is substantially circular;

the protrusion-receiving groove is convex with respect to a center of the first curved surface such that it opens away from the center of the first curved surface; and each of the second and third curved surfaces is concave with respect to the center of the first curved surface such that it opens toward the center of the first curved surface.

8. The rotary device of claim 7, wherein:

one or more voids are provided in each of the one or more second rotors on an opposite side of the center of the first curved surface from the protrusion-receiving groove; and the one or more voids are sized and shaped to balance each of the one or more second rotors around the center of the first curved surface.

9. A method for making a rotary device comprising a first rotor that rotates adjacent to one or more second rotors, the method comprising the steps of:

making the first rotor by forming a substantially circular main body with two or more protrusions extending radially from the main body and at least a pair of voids in the main body between each adjacent pair of the two or more protrusions, each protrusion comprising a leading side and a trailing side opposite the leading side, and each pair of voids being spaced from each adjacent pair of voids by a distance greater than that between each adjacent void in each pair of voids; and making the second rotor by:

forming a first curved surface that is configured to move adjacent to the main body of the first rotor between the protrusions as the first rotor and one or more second rotors rotate relative to one another;

forming a protrusion-receiving groove extending into the one or more second rotors that is configured to receive one of the plurality of protrusions therein so that at least a tip of the one protrusion moves adjacent to the protrusion-receiving groove as the first rotor and one or more second rotors rotate relative to one another; and forming a second curved surface and a third curved surface extending away from a center of the protrusion-receiving groove on opposing sides of the protrusion-receiving groove that are configured to move adjacent to the leading side and the trailing side of the one protrusion, respectively.

10. The method of claim 9, wherein:

the first curved surface is formed such that the adjacency of the main body of the first rotor and the first curved surface of the one or more second rotors provides a non-contact seal between the main body of the first rotor and the first curved surface of the one or more second rotors;

the protrusion-receiving groove is formed such that the adjacency of at least the tip of the one protrusion and the protrusion-receiving groove provides a non-contact seal between at least the tip of the one protrusion and the protrusion-receiving groove; and the second and third curved surfaces are formed such that the adjacent of at least the leading and trailing sides of the one protrusion and the second and third curved surfaces provide a non-contact seal between at least the leading and trailing sides of the one protrusion and the second and third curved surfaces.

11. The method of claim 10, wherein the protrusion-receiving groove is formed such that at least two points of adjacency when at least opposing edges of the tip of the one protrusion are received therein as the first rotor and one or more second rotors rotate relative to one another.

12. The method of claim 11, wherein:

the second curved surface is formed such that at least one point of adjacency is provided with the leading side of the one protrusion while the first curved surface provides at least one point of adjacency with the main body of the first rotor; and the third curved surface is formed such that at least one point of adjacency is provided with the trailing side of the one protrusion while the first curved surface provides at least one point of adjacency with the main body of the first rotor.

13. The method of claim 9, further comprising the steps of:

providing a rotor encasement comprising a central opening;

providing the first rotor with five or more protrusions;

rotatably disposing the first rotor within the central opening; and rotatably disposing three or more second rotors at an edge of the central opening.

14. The method of claim 9, further comprising the steps of:

providing a rotor encasement comprising a central opening;

rotatably disposing the first rotor within the central opening; and rotatably disposing two or more second rotors at an edge of the central opening, wherein the rotor encasement comprises an intake port and an exhaust port between each adjacent pair of the two or more second rotors such that at least two areas are provided between each adjacent pair of the two or more second rotors and each of the at least two areas is configured to be utilized as either a compressor or expander as fluid enters the intake port and exits the exhaust port in that area.

15. The method of claim 9, wherein:

the first curved surface is substantially circular;

the protrusion-receiving groove is convex with respect to a center of the first curved surface such that it opens away from the center of the first curved surface; and each of the second and third curved surfaces is concave with respect to the center of the first curved surface such that it opens toward the center of the first curved surface.

16. The method of claim 15, further comprising the steps of forming one or more voids in each of the one or more second rotors on an opposite side of the center of the first curved surface from the protrusion-receiving groove, wherein the one or more voids are sized and shaped to balance each of the one or more second rotors around the center of the first curved surface.

* * * * *